US010646056B2

(12) United States Patent
Tirmandas et al.

(10) Patent No.: US 10,646,056 B2
(45) Date of Patent: May 12, 2020

(54) BACK END STOCKING SHELVING

(71) Applicant: Walmart Apollo, LLC, Bentonville, AR (US)

(72) Inventors: Akhilesh Tirmandas, Bentonville, AR (US); Jason D. Bellar, Bentonville, AR (US)

(73) Assignee: Walmart Apollo, LLC, Bentonville, AR (US)

( * ) Notice: Subject to any disclaimer, the term of this patent is extended or adjusted under 35 U.S.C. 154(b) by 255 days.

(21) Appl. No.: 15/480,559

(22) Filed: Apr. 6, 2017

(65) Prior Publication Data

US 2017/0290448 A1 Oct. 12, 2017

Related U.S. Application Data

(60) Provisional application No. 62/319,199, filed on Apr. 6, 2016.

(51) Int. Cl.

| | |
|---|---|
| ***A47F 10/02*** | (2006.01) |
| ***A47F 11/00*** | (2006.01) |
| ***A47F 1/12*** | (2006.01) |
| ***A47F 5/00*** | (2006.01) |
| ***A47F 5/10*** | (2006.01) |
| ***E04H 1/12*** | (2006.01) |

(52) U.S. Cl.

CPC ..... *A47F 10/02* (2013.01); *A47F 1/12* (2013.01); *A47F 5/0018* (2013.01); *A47F 11/00* (2013.01); *E04H 1/12* (2013.01); *A47F 5/10* (2013.01); *A47F 2010/025* (2013.01)

(58) Field of Classification Search

CPC ..... A47F 10/02; A47F 1/12; A47F 5/0018; A47F 11/00; A47F 5/10; A47F 2010/025; E04H 1/12

See application file for complete search history.

(56) References Cited

U.S. PATENT DOCUMENTS

| | | | | |
|---|---|---|---|---|
| 1,425,789 | A * | 8/1922 | Moseley | B60P 3/0257 296/24.36 |
| 3,716,697 | A * | 2/1973 | Weir | G06Q 20/342 235/383 |
| 3,741,345 | A * | 6/1973 | Saridis | A47F 10/00 186/55 |
| 4,471,586 | A * | 9/1984 | Shuch | E04H 1/1222 312/321.5 |

(Continued)

OTHER PUBLICATIONS

FRR Merchandising; 3-Tier Gravity Feed Merchandiser; http://www.ffr.com/3-tier-gravity-feed-merchandiser; Jan. 31, 2016; 2 pages.

(Continued)

*Primary Examiner* — Saul Rodriguez
*Assistant Examiner* — Ashley K Romano
(74) *Attorney, Agent, or Firm* — Fitch, Even, Tabin & Flannery LLP

(57) ABSTRACT

In some embodiments, various systems, apparatuses and methods are described herein includes back end stocking shelving units that are configured to extend along sides of adjacent shopping aisles in a back-to-back configuration with a secure central aisle running between the shelving units to provide back end stocking access to both shelving units. The secure central aisle can have a restricted access point on one or both ends thereof.

16 Claims, 5 Drawing Sheets

(56) References Cited

U.S. PATENT DOCUMENTS 4,765,492 A * 8/1988 Howard ..... A47B 96/06 108/61
4,975,012 A * 12/1990 Motoda ..... B65G 1/04 109/1 R
4,997,076 A * 3/1991 Hirschfeld ..... G07F 7/069 194/212
5,016,736 A * 5/1991 Vayda ..... B65G 1/045 186/53
5,186,281 A * 2/1993 Jenkins ..... A47F 10/02 186/55
5,226,266 A * 7/1993 Cernuto ..... E04H 1/1222 211/128.1
5,271,703 A * 12/1993 Lindqvist ..... G06Q 10/08 186/55
5,439,122 A 8/1995 Ramsay
5,478,183 A * 12/1995 Savigny ..... B65G 1/0435 186/49
D382,975 S * 8/1997 Bolton ..... D25/16
5,692,342 A * 12/1997 Devlin ..... A47F 10/00
5,871,108 A 2/1999 White
D411,017 S * 6/1999 Kleihues ..... D25/16
5,957,397 A * 9/1999 Kelly ..... B02C 19/0068 241/19
5,983,202 A * 11/1999 Yabe ..... G06Q 10/087 235/385
5,992,651 A 11/1999 Shaw
6,142,317 A 11/2000 Merl
6,189,944 B1 * 2/2001 Piche ..... B60P 3/0257 296/22
6,302,279 B1 10/2001 Robolin
6,405,880 B1 * 6/2002 Webb ..... A47F 1/12 108/107
6,561,365 B2 * 5/2003 Bustos ..... A47F 5/0018 211/187
6,640,569 B2 * 11/2003 Goosman ..... B60H 1/3232 296/37.1
6,655,892 B2 * 12/2003 Strohfus ..... B60P 3/055 414/334
6,736,075 B2 * 5/2004 Jackson ..... A47F 5/10 108/50.01
6,760,643 B2 * 7/2004 Lipps ..... A61G 12/001 221/2
7,174,736 B2 * 2/2007 Chen ..... B60H 1/00014 62/239
D545,450 S * 6/2007 Whalen ..... D25/16
D556,341 S * 11/2007 Jackson ..... D25/16
7,558,743 B2 * 7/2009 Razumov ..... G06Q 10/087 186/53
8,820,481 B2 * 9/2014 Brucia ..... A47B 91/06 186/52
10,181,113 B2 * 1/2019 Rivalto ..... G07F 7/08
2011/0210084 A1 * 9/2011 Hardy ..... A47F 3/002 211/4
2014/0091696 A1 * 4/2014 Welker ..... A47F 5/0043 312/408
2014/0124527 A1 * 5/2014 Quiring ..... G07F 11/14 221/150 R
2015/0259939 A1 * 9/2015 Horvath ..... E04H 1/1222 296/24.36

OTHER PUBLICATIONS

Store Bulk Bins; Clear acrylic slant shelves; http://storebulkbins.com/clear-acrylic-slant-shelves.html; Jan. 31, 2016; 1 page.
Alibaba; Round faced acrylic candy bins display stand; http://www.alibaba.com/product-detail/Round-faced-acrylic-candy-bins-display_510663740/showimage.html; Jan. 31, 2016; 2 pages.
Alibaba; Slanted Shelving Merchandiser Display shelving; http://www.alibaba.com/product-detail/Slanted-Shelving-Merchandiser-Display-shelving_493745807.html; Jan. 31, 2016; 5 pages.
Alibaba; Commercial stainless steel adjustable storage cold room shelving; http://www.alibaba.com/product-detail/Commercial-stainless-steel-adjustable-storage-cold_60082976984.html; Jan. 31, 2016; 7 pages.

* cited by examiner

BACK END STOCKING SHELVING

CROSS-REFERENCE TO RELATED APPLICATIONS

This application claims the benefit of U.S. Provisional Application No. 62/319,199, filed Apr. 6, 2016, which is hereby incorporated by reference herein in its entirety.

TECHNICAL FIELD

This invention relates generally to shelving for retail locations.

BACKGROUND

Retail locations often utilize modular shelving units to display products for sale. One common configuration for such modular shelving units include a base, a backing wall, and shelving extending outwardly from the backing wall on one or both sides thereof. This configuration allows the retail location to efficiently utilize available retail area. With this configuration, however, associates have to stock the shelves from the front which can have several disadvantages. For example, the products to be stocked, as well as the associates, can interfere with a shopping customer by blocking shelving and taking up space in the aisle. In another example, an associate may stock new products in front of older products, which can result in unnecessary expirations.

BRIEF DESCRIPTION OF THE DRAWINGS

Disclosed herein are embodiments of systems, apparatuses and methods pertaining to shelving systems having back-end stocking from a secure central aisle disposed between shelving units. This description includes drawings, wherein.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, systems, apparatuses and methods are provided herein that are useful for providing shelving units with a secure back end stocking aisle. The shelving described herein provides back end stocking shelving units that are configured to extend along sides of adjacent shopping aisles in a back-to-back configuration with a secure central aisle running between the shelving units to provide back end stocking access to both shelving units. The secure central aisle can have a restricted access point on one or both ends thereof. So configured, stocking can be done out of the way of the public, including the products to be stocked, the carts for the products, and the associates, and older products are ensured to be stocked at the front of the shelves.

Figure 1:
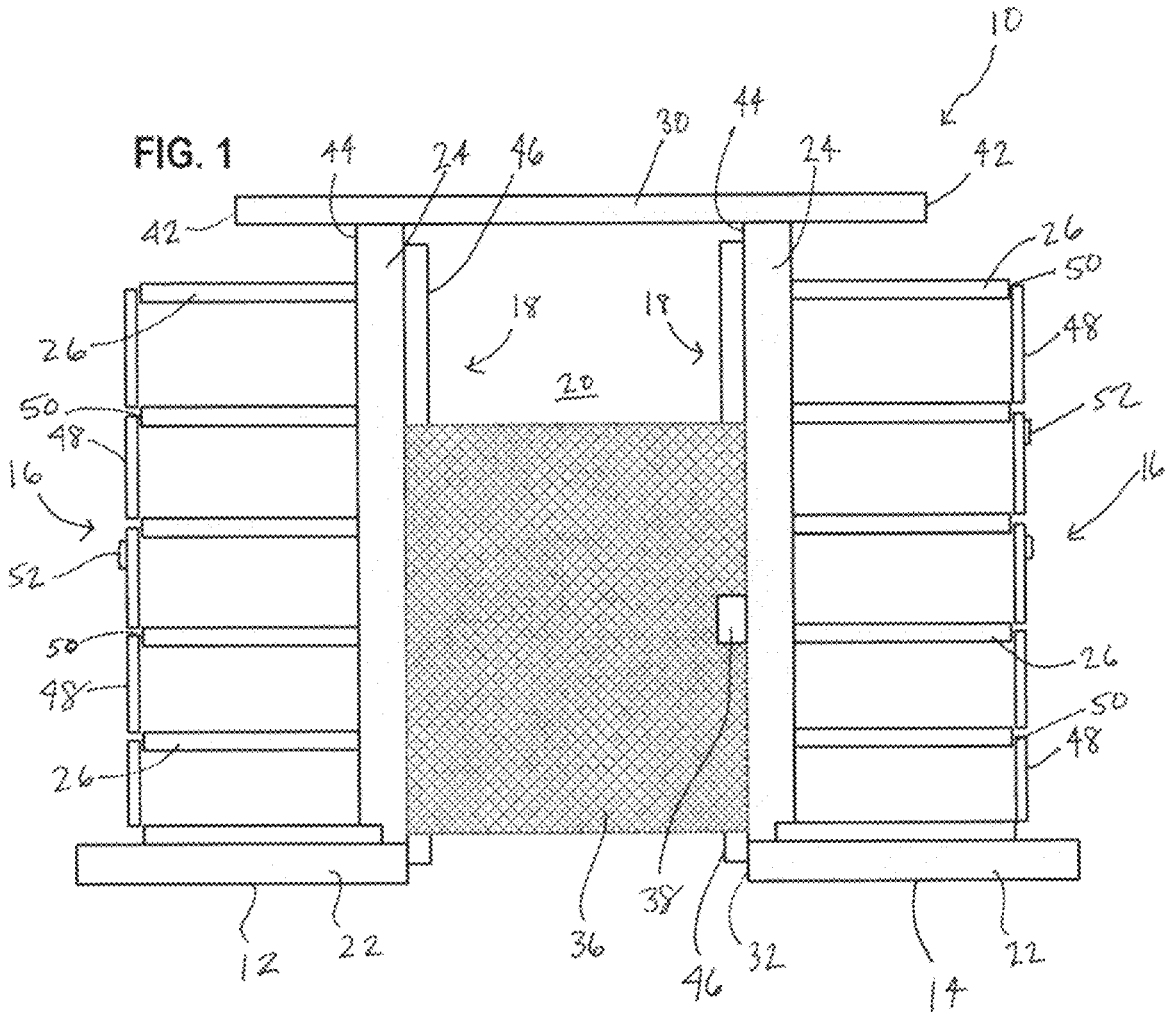
FIG. 1 is a side elevation view of a shelving system having first and second shelving units and a secure central aisle running therebetween showing a gate blocking access to the secure central aisle in accordance with some embodiments.
Figure 2:
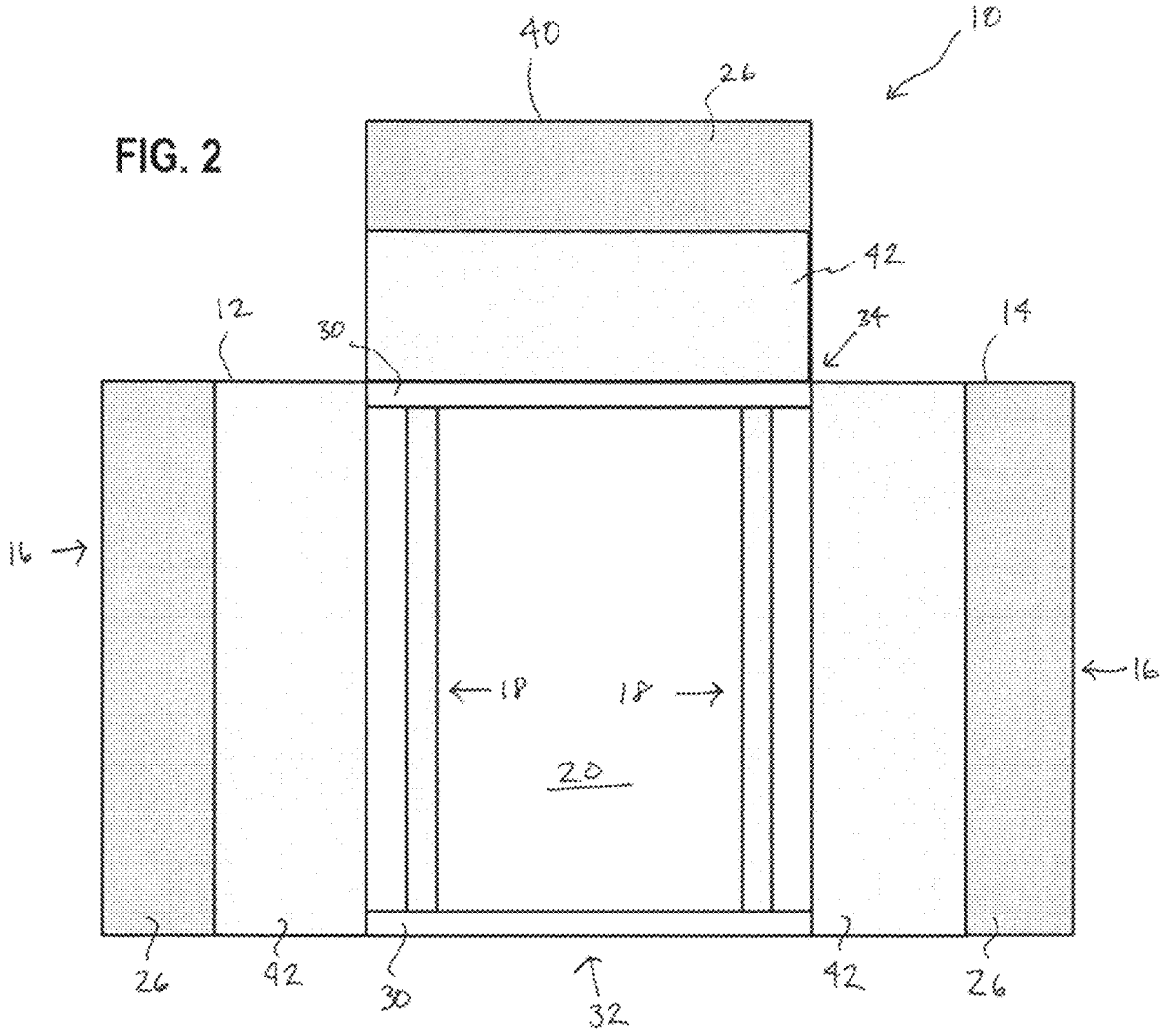
FIG. 2 is a top plan view of the shelving system of FIG. 1 showing the first and second shelving units, the secure central aisle, and an end cap shelving unit in accordance with several embodiments.
Figure 3:
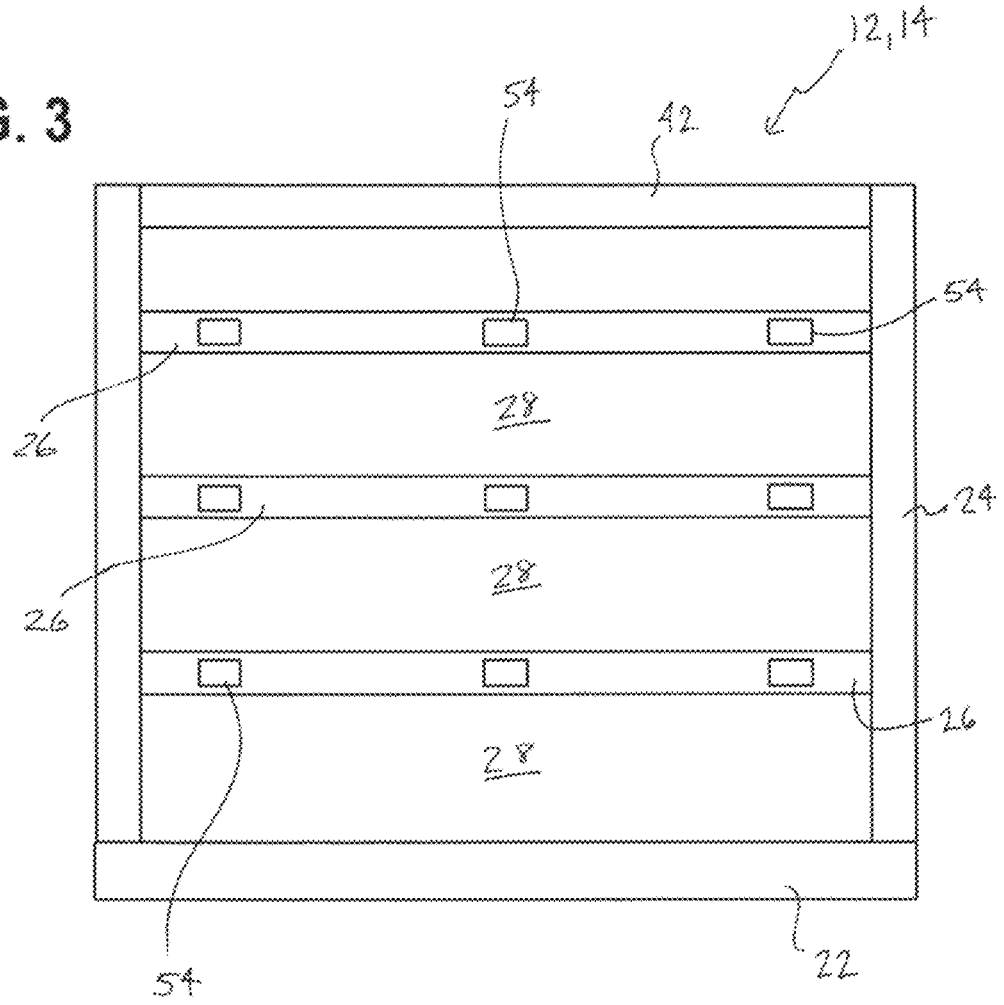
FIG. 3 is a back elevation view of a shelving unit of FIG. 1 showing stocking labels on shelves thereof in accordance with some embodiments.

A shelving system 10 providing these advantages is shown in FIGS. 1 and 2. The shelving system 10 includes first and second shelving units 12, 14 with outwardly facing front ends 16 and inwardly facing back ends 18. A central aisle 20 runs between the first and second shelving units 12, 14 such that a user can access the back ends 18 thereof.

Each shelving unit 12, 14 includes a base portion 22, a back frame or wall 24, and shelves 26 mounted to, and extending forwardly of, the back frame 24. If desired, the shelves 26 can be removably mounted to the back frame 24 so that the heights thereof can be adjusted. Alternatively, the shelves 26 can be fixedly mounted to the back frame 24. As set forth above, the back frame 24 includes one or more openings 28 therethrough so that the shelves 26 can be accessed from the central aisle 20 through the openings 28. So configured, the shelving system 10 provides convenient back-end stocking, such that the products to be stocked, the cart holding the products, as well as the associate stocking the products can all be located out of public areas. This additionally ensures that older products are disposed at the front of the shelves 26 because an associate would push the older products forward while stocking newer products from the back-end of the shelving units 10, 12. Advantageously, this configuration allow an associate to stock products on a shelf 26 from the back-end 18 of the shelving units 10, 12 and another associate to remove any expired products from the front-end 16 of the shelving units 10, 12 at the same time. The shelves can extend at a generally orthogonal direction from the back frame 24 or, if desired, can extend at a downwardly inclined direction as they extend forwardly from the back frame 24 or include a downwardly inclined portion so that stocking products on the shelves 26 can be gravity assisted.

The first and second shelving units 12, 14 are secured or connected together by connection members or bars 30 that extend between the shelving units 12, 14 over or across the central aisle 20. The connection members 30 advantageously stabilize the shelving units 12, 14 and maintain the spacing of the central aisle 20. For example, the first and second shelving units 12, 14 can have a width of about 2 feet and the central aisle can be about 4 feet, such that, in this example, the shelving system 10 has a width of about 8 feet. So configured, the shelving system takes up about double the floor space as compared to traditional shelving. Of course, the width of the central aisle 20 can be increased or decreased as desired.

The central aisle 20 can further be secured so that access is restricted thereto. This advantageously prevents public access to the central aisle 20 such that the central aisle can be used for secure storage. As shown, the central aisle 20 includes first and second ends 32, 34 having openings extending between the first and second shelving units 12, 14. In order to secure access to the central aisle 20, a gate 36 can span the opening at either or both of the first and second ends 32, 34 thereof. The gate 36 can be any suitable mechanism, including a door, a grate, etc., which can pivot, roll up, or be collapsible as desired. The gate 36 can further include a locking mechanism 38 to provide additional protection against undesired access to the central aisle 20.

If desired, one of the ends 32, 34 can be permanently blocked off with a wall so that the central aisle 20 can only be accessed through the other end 32, 34. By one approach, instead of a wall, the end 32, 34 of the central aisle 20 can be blocked with an end cap shelving unit 40. Similar to the first and second shelving units 12, 14, the end cap shelving unit 40 includes a base portion 22, a back frame or wall 24, and shelves 26 mounted to, and extending forwardly of, the back frame 24. The shelves 26 can be configured as set forth above. So configured, a user can access both the first and second shelving units 12, 14 from the central aisle 20, as well as the end cap shelving unit 40. Accordingly, the user has back end stocking access to three shelving units that are orthogonal to adjacent units.

As shown in FIGS. 1 and 2, the first and second shelving units 12, 14 can further include top shelves 42 mounted at a top portion 44 of the back frame 24. The top shelves 42 can advantageously be used for storage, as they may not be conveniently located for customer access. By one approach, the top shelves 42 can have a smaller dimension than the other shelves 26. As shown, the top shelves 42 are recessed with respect to the other shelves 26 mounted to the back frame 24. So configured, it can be difficult for an associate to reach the top shelves 42 to both stock and access products thereon. The shelving system 10 as described herein advantageously provides easy access to the top shelves 42 because an associate can reach the rear of the top shelves 42 from the central aisle 20, so the recessed front does not affect access and stocking.

In the illustrated form, the top shelves 42 are spaced from one another on either side of the central aisle 20. As such, a user can stock the top shelves 42 from the central aisle, optionally with a step ladder or the like if needed. By another approach, the top shelves 42 can be joined into a single shelf that spans the central aisle 20, providing an unbroken surface for storage above the shelving units 12, 14.

The shelving system 10 can further include one or more back covers 46 mounted on the back frames 24 of the first and second shelving units 12, 14. The back covers 46 can advantageously provide a back surface for the shelves 26 so that customers looking at products on the shelves 26 do not see into the central aisle 20 and to the opposite shelving unit 12, 14. By some approaches, the back covers 46 can be movably mounted to the back frames 24. For example, the back covers 46 can be slidably mounted to the back frames 24, so that a user can slide the back cover 46 sideways to access a desired shelf 26. The back cover 46 can also be flexible such that it can be rolled upwardly or collected adjacent to a desired shelf 26. If desired, the end cap shelving unit 40 can also be configured with a back cover 46.

In some approaches, as shown in FIG. 1, the shelves 26 of the first and second shelving units 12, 14 can have front covers or flaps 48 mounted thereto. The front covers 48 can mount to extend across the access opening to the shelves in order to minimize products falling off the shelves. If desired, the front cover 48 can have product information printed or adhered thereon for providing information to consumers. By one approach, the front covers 48 can be pivotably mounted to the shelves 26 by a hinge 50 and hang downwardly therefrom to cover the shelf opening therebelow. By another approach, the front covers 48 can be flexible. So configured, when a consumer wants to access the shelf 26, the consumer can pivot or manipulate the front cover 48 upwardly.

With traditional front-stocked shelving, the front of the shelves can be the most convenient location for product information, such as a product name, price information, stocking information, and the like. As a result, the labeling can be cramped and it can be difficult for a consumer to find relevant information. Advantageously, with the back-end stocking provided by the shelving system 10 described herein, the labeling can be separated between the front ends 16, providing information relevant to the customers, and the back ends 18, providing information relevant to the associates. As a result of this configuration, the customer-relevant information, such as product name and price, can be more largely printed and be more conspicuous on a front label 52 than the traditional labeling. Further, the associate-relevant information, such as stocking and storage information, can be provided on a back label 54 visible from the central aisle 20.

Figure 4:
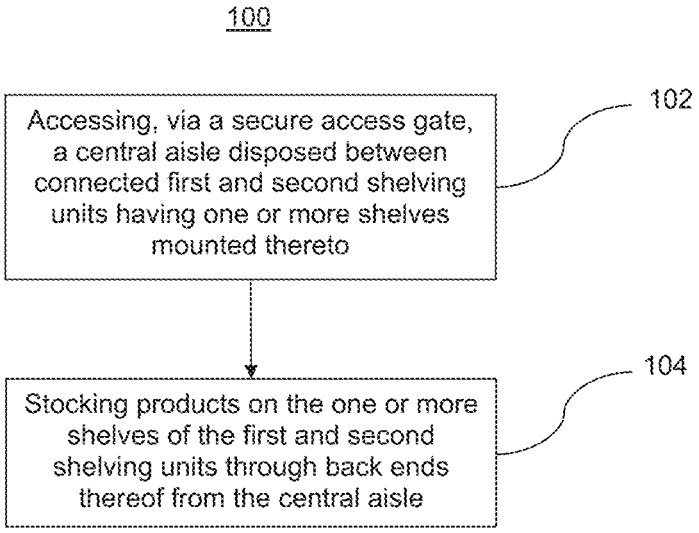
FIG. 4 is a flowchart in accordance with several embodiments.

So configured, as shown in FIG. 4, an associate can utilize the shelving system 10 for secured, back-end stocking 100. The associate first accesses 102, via the gate 36, the central aisle 20. The associate can then stock 104 products on the shelves 26 of the first and second shelving units 12, 14 through the back ends 18 thereof. More specifically, the associates can stock the products through the openings 28 in the back frames 24 of the first and second shelving units 12, 14.

Figure 5:
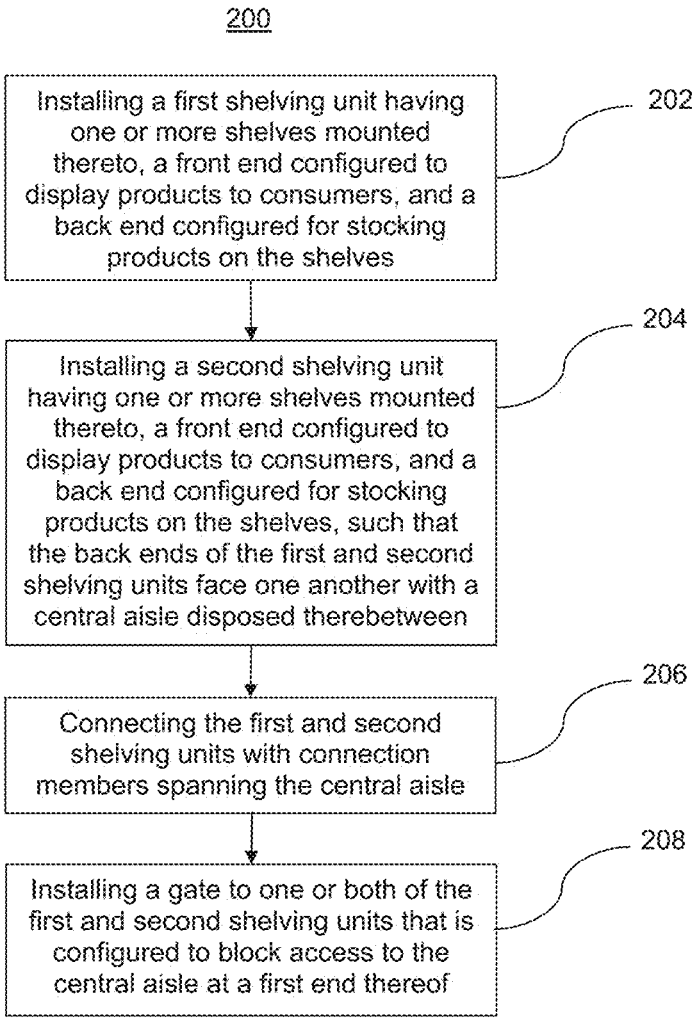
FIG. 5 is a flowchart in accordance with some embodiments.

Additionally, as shown in FIG. 5, an associate can install 200 the shelving system 10 described herein. The associate can install 202 the first shelving unit 12 and the second shelving unit 14 configured as set forth above including the shelves 26 with front and back ends 16, 18. As described, the back ends 18 of the first and second shelving units 12, 14 face one another with the central aisle 20 therebetween. The associate can then connect 206 the first and second shelving units 12, 14 with the connection members 30 spanning the central aisle 20. The associate can then install 208 the gate 36 to one or both of the first and second shelving units 12, 14 so that the gate blocks access to the central aisle 20 at one of the ends 32, 34 thereof.

In some embodiments, a back end stocking shelving system is described herein that includes first and second shelving units. Each shelving unit has one or more shelves mounted thereto, a front end configured to display products to consumers, and a back end configured to allow stocking workers to stock products on the one or more shelves. The shelving system further includes a central aisle that is disposed between the first and second shelving units and includes a first end. The first and second shelving units can be oriented so that the back ends thereof face the central aisle. One or more connection members span the central aisle to connect the first and second shelving units. The shelving system can further include a gate coupled to one or both of the first and second shelving units that is configured to block access to the central aisle at the first end thereof. So configured, the stocking workers can access the central aisle via the gate and the consumers cannot access the central aisle via the gate.

In further embodiments, the central aisle can include a second end and the shelving system can further include an end cap shelving unit that is disposed across the central aisle at the second end thereof. By one approach, the end cap shelving unit can include a back end for stocking products accessible from the central aisle.

In several embodiments, a method for back end stocking of a plurality of shelving units is described herein and includes accessing, via a secure access gate, a central aisle disposed between connected first and second shelving units. The first and second shelving units can include one or more shelves mounted thereto, a front end configured to display products to consumers, and a back end configured to allow stocking workers to stock products on the one or more shelves. The first and second shelving units can be oriented so that the back ends thereof face the central aisle. The method further includes stocking products on the one or more shelves of the first and second shelving units through the back ends thereof from the central aisle.

In further embodiments, accessing the central aisle can include unlocking the secure access gate which blocks a first end of the central aisle. By another approach, an end cap shelving unit having a back end for stocking products on shelves thereof can span the central aisle at a second end thereof. So configured, stocking products on the one or more shelves of the first and second shelving units can further include stocking products on the shelves of the end cap shelving unit through the back end thereof from the central aisle.

In some embodiments, a method for installing a back end stocking shelving system is described herein and includes installing a first shelving unit and installing a second shelving unit, where the first and second shelving units include one or more shelves mounted thereto, a front end configured to displaying products to consumers, and a back end for stocking products on the shelves. The first and second shelving units can be oriented such that the back ends thereof face one another with a central aisle disposed therebetween. The method can further include connecting the first and second shelving units with connection members spanning the central aisle and installing a gate to one or both of the first and second shelving units that is configured to block access to the central aisle at a first end thereof, wherein stocking workers can access the central aisle via the gate and consumers cannot access the central aisle via the gate.

In further embodiments, the method can include installing an end cap shelving unit at a second end of the central aisle, where the end cap shelving unit includes one or more shelves mounted thereto, a front end for displaying products to consumers, and a back end for stocking products on the shelves. So configured, the back ends of the first, second, and end cap shelving units can be accessible from the central aisle.

Those skilled in the art will recognize that a wide variety of other modifications, alterations, and combinations can also be made with respect to the above described embodiments without departing from the scope of the invention, and that such modifications, alterations, and combinations are to be viewed as being within the ambit of the inventive concept.

What is claimed is:

1. A back end stocking shelving system comprising:

first and second shelving units, each having one or more shelves mounted thereto, a front end configured to display products to consumers, and a back end configured to allow stocking workers to stock products on the one or more shelves;

a central aisle disposed between the first and second shelving units and including a first end, the first and second shelving units oriented so that the back ends thereof face the central aisle;

one or more connection members spanning the central aisle and connecting the first and second shelving units; and a gate coupled to one or both of the first and second shelving units and configured to block access to the central aisle at the first end thereof, wherein the stocking workers can access the central aisle via the gate, and the consumers cannot access the central aisle via the gate;

wherein the first shelving unit comprises a first top storage shelf mounted, at a back end of the first top storage shelf, above and separated from a top most shelf of the one or more shelves of the first shelving unit and configured to support products and to be used for storage of products above the one or more shelves of the first shelving unit, wherein a front end of the first top shelf is recessed with respect to the front ends of the one or more shelves of the first shelving unit such that the first top storage shelf is not conveniently located for customer access while a back end is readily accessible to a worker from the central aisle to both stock and access products thereon;

wherein the second shelving unit comprises a second top storage shelf mounted, at a back end of the second top storage shelf, above and separated from a top most shelf of the one or more shelves of the second shelving unit and configured to support products and to be used for storage of products above the one or more shelves of the second shelving unit, wherein a front end of the second top shelf is recessed with respect to the front ends of the one or more shelves of the second shelving unit such that the second top storage shelf is not conveniently located for customer access while a back end is readily accessible to a the worker from the central aisle to both stock and access products thereon;

wherein the first and second shelving units each comprise back labels secured proximate the back ends of each of the one or more shelves of the first shelving units and each of the one or more shelves of the second shelving unit, wherein each of the back labels comprises stocking information relevant to workers tasked to stock at least one of the first shelving unit and the second shelving unit and wherein the stocking information of different ones of the back labels is relevant to different ones of the different products intended to be supported by the respective one or more shelves of the respective first and second shelving units; and wherein the first and second shelving units include front labels secured proximate the front ends of each of the one or more shelves of the first shelving units and each of the one or more shelves of the second shelving unit, wherein the front labels comprise product information that is different than the stocking information and that is relevant to customers, wherein each of the front labels comprises a product name and price information corresponding to the different ones of the different products intended to be supported by the respective one or more shelves of the respective first and second shelving units.

2. The back end stocking shelving system of claim 1, wherein the central aisle includes a second end, the system further comprising an end cap shelving unit disposed across the central aisle at the second end thereof.

3. The back end stocking shelving system of claim 2, wherein the end cap shelving unit includes a back end for stocking products accessible from the central aisle.

4. The back end stocking shelving system of claim 1, wherein the shelves of the first and second shelving units include inclined portions for gravity assisted stocking.

5. The back end stocking shelving system of claim 1, wherein the first and second shelving units include a back cover extending over at least a portion of the back ends thereof, the back cover configured to cover at least a portion of the back end when not stocking.

6. The back end stocking shelving system of claim 5, wherein the back cover comprises one or more slidable doors mounted to the first and second shelving units.

7. The back end stocking shelving system of claim 1, wherein the shelves of the first and second shelving units include a transparent front cover blocking access thereto at the front end thereof, the transparent front cover being movable to permit access to the shelf for the consumers.

8. The back end stocking shelving system of claim 1, wherein:

the first shelving unit comprises a first back frame, wherein the one or more shelves of the first shelving unit are removably secured with the first back frame and extend at generally an orthogonal direction from the back frame with the back end of each of the one or more shelves of the first shelving unit positioned proximate the first back frame and the front end each of the one or more shelves of the first shelving unit are positioned distant from the first back frame; and the second shelving unit comprises a second back frame, wherein the one or more shelves of the second shelving unit are removably secured with the second back frame and extend at generally an orthogonal direction from the back frame with the back end of each of the one or more shelves of the second shelving unit positioned proximate the second back frame and the front end each of the one or more shelves of the second shelving unit are positioned distant from the second back frame.

9. The back end stocking shelving system of claim 8, wherein:

wherein the one or more shelves of the first shelving unit comprise a plurality of first shelves that are removably secured with the first back frame and adjustable enabling heights between the plurality of first shelves to be adjusted; and wherein the one or more shelves of the second shelving unit comprise a plurality of second shelves that are removably secured with the second back frame and adjustable enabling heights between the plurality of second shelves to be adjusted.

10. The back end stocking shelving system of claim 9, wherein the central aisle further comprises a second end opposite the first end; and further comprising first and second end cap shelving units each disposed at a respective one of the first end of the central aisle and the second end of the central aisle.

11. The back end stocking shelving system of claim 10, wherein the central aisle has a width about twice the width of the first shelving unit.

12. The back end stocking shelving system of claim 11, wherein the second top shelf is spaced from the first top shelf by at least a portion of the central aisle.

13. The back end stocking shelving system of claim 11, wherein the first top shelf and the second top shelf are joined into a single top shelf that spans the central aisle providing a surface for storage above the first and second shelving units.

14. The back end stocking shelving system of claim 9, wherein the second top shelf is spaced from the first top shelf by at least a portion of the central aisle.

15. The back end stocking shelving system of claim 9, wherein the first top shelf and the second top shelf are joined into a single top shelf that spans the central aisle providing a surface for storage above the first and second shelving units.

16. The back end stocking shelving system of claim 8, wherein the central aisle has a width about twice the width of the first shelving unit.

* * * * *